US006550286B2

(12) United States Patent
Querquant

(10) Patent No.: US 6,550,286 B2
(45) Date of Patent: Apr. 22, 2003

(54) LINGERIE ARTICLES PRODUCED FROM CYLINDRICAL KNITTING COMPRISING RETAINING CHARACTERISTICS

(75) Inventor: Pierre-Jean Querquant, Bourgoin Jallieu (FR)

(73) Assignee: Playtex Apparel, Inc., Stamford, CT (US)

( * ) Notice: Subject to any disclaimer, the term of this patent is extended or adjusted under 35 U.S.C. 154(b) by 0 days.

(21) Appl. No.: 10/049,741

(22) PCT Filed: May 30, 2001

(86) PCT No.: PCT/FR01/01685

§ 371 (c)(1),
(2), (4) Date: May 21, 2002

(87) PCT Pub. No.: WO01/93708

PCT Pub. Date: Dec. 13, 2001

(65) Prior Publication Data

US 2002/0155786 A1 Oct. 24, 2002

(30) Foreign Application Priority Data

Jun. 9, 2000 (FR) ..... 00 07458

(51) Int. Cl.[7] ..... A41C 3/00
(52) U.S. Cl. ..... 66/176; 66/202; 450/40
(58) Field of Search ..... 66/171, 175, 176, 66/202; 450/92, 93, 76, 65, 66, 39, 40; 264/258, 257; 156/196, 245

(56) References Cited

U.S. PATENT DOCUMENTS

| | | | | |
|---|---|---|---|---|
| 3,772,899 A | | 11/1973 | Novi | 66/176 |
| 4,372,322 A | * | 2/1983 | Stern et al. | 450/67 |
| 5,406,646 A | | 4/1995 | Balit et al. | 2/67 |
| 5,447,462 A | | 9/1995 | Smith et al. | 450/122 |
| 5,479,791 A | | 1/1996 | Osborne | 66/171 |
| 5,553,468 A | * | 9/1996 | Osborne | 66/171 |
| 5,592,836 A | * | 1/1997 | Schuster et al. | 66/176 |
| 5,605,060 A | * | 2/1997 | Osborne | 68/171 |
| 6,000,994 A | | 12/1999 | Salotto | 450/92 |
| 6,287,168 B1 | * | 9/2001 | Rabinowicz | 450/75 |

FOREIGN PATENT DOCUMENTS

| | | | |
|---|---|---|---|
| CH | 513601 A | | 11/1971 |
| DE | 2110464 | * | 9/1970 |
| EP | 0809945 B1 | | 9/1999 |

* cited by examiner

*Primary Examiner*—Danny Worrell
(74) *Attorney, Agent, or Firm*—Ohlandt, Greeley, Ruggiero & Perle, L.L.P.

(57) ABSTRACT

The invention concerns lingerie articles comprising at least a moulded region to create a retaining and supporting volume of at least a curved part of the human body, made from a tubular knitted fabric (1) formed with a first extensible and thermoformable material, provided with a ribbing (2) which forms one of the edges of said article elastically enclosing the body, the final shape of the article being produced by cuts performed in the tubular knitted fabric from the free end opposite the ribbing. The invention is characterized in that each moulded volume region is lined by internal bonding of a least a lining (9) consisting of a second extensible heat-activated material whereof one surface is coated with an adhesive material capable of being heat-activated, the materials of the knitted fabric and of the lining having either thermoformed or elastic percent elongation, and the adhesive having an activating temperature such that they enable deformation induced by hot moulding of the moulded regions to provide them with volume without affecting the heat-bonded linkage, said first (1) and second (9) materials preserving their supporting and retaining capacity after moulding.

25 Claims, 3 Drawing Sheets

LINGERIE ARTICLES PRODUCED FROM CYLINDRICAL KNITTING COMPRISING RETAINING CHARACTERISTICS

FIELD OF THE INVENTION

The present invention relates to an item of support lingerie having at least one molded region to create a retaining and support volume for at least one protuberant part of the human body.

The articles in question are primarily brassieres and briefs, in which the cups and the part covering the buttocks respectively may incorporate substantially mechanical features designed to impart to them a support function and even to lift the breasts and buttocks of the users.

BACKGROUND OF THE INVENTION

Manufacturers in the lingerie sector are constantly faced with a dual challenge: that of ensuring maximum comfort on the one hand whilst providing an optimum support and retaining function on the other. Historically, the problem initially cropped up with brassieres, whilst the idea of molding and hence supporting the buttocks by means of the actual structure of the briefs in a manner similar to that applied to the breasts is a more recent phenomenon.

Traditionally, items of lingerie have been made using cut pieces which are then sewn together, particularly in the zones intended to form a three-dimensional capacity, such as the cups of brassieres. In order to improve wearing comfort, the idea was posited that stitching should be reduced as far as possible, especially since stitched seams form extra thicknesses which can be irritating where they come into contact with the skin. Bonding and even welding techniques were therefore developed and applied in this field with a view to reducing or even eliminating the presence of these stitched seams.

Patent document EP 0 809 945, for example, discloses a brassiere manufactured from a material incorporating heat-weldable fibers, the various components of the brassiere made from this material being assembled with one another by heat-welding in order to impart the final shape to said brassiere.

Although stitching is eliminated, the plurality of welded zones, particularly in the bottom part of the brassiere surrounding the bust, nevertheless involves the use of some relief areas which are elastically supported against the skin and have a perceptible effect on wearing comfort.

In order to overcome this drawback, brassieres have been developed in which the periphery is made in a single piece from a tubular knitted fabric. In reality, these brassieres tend not to have cups for the breasts and are designed for women with a small chest or for sporting purposes and compress the breasts rather than support them. Similarly, briefs made from tubular knitted fabric do not have any means of supporting or lifting the buttocks, although they do afford good peripheral compression.

In situations where several pieces are not stitched together to impart a three-dimensional shape to the cups, it is necessary to use textile fibers that are both elastic and whose elongation can be modified in order to provide the support characteristics and adapt to different bust sizes. For example, heat-deformable fibers are used to enable the cups or buttock regions to be heat-molded, thereby imparting a three-dimensional configuration to accommodate the breasts or buttocks.

However, the ability to mold fibres is not enough on its own because it is also vital to impart mechanical strength in order to support and hold these parts of the body. Generally speaking, this mechanical strength is not needed merely in the region supporting the buttocks or breasts but also needs to be imparted to the article of lingerie generally in order to take account of the day-to-day strain to which different parts of the item are subjected. Accordingly, it is necessary to preserve a certain degree of strength in the back tabs of a brassiere, which is also subjected to strain as the bust of the user moves.

Another necessary feature is the ability to withstand washing, sometimes at a high temperature, which may affect the durability of the mechanical characteristics of the fibers.

For this reason, it is preferable to provide a fabric lining, at least in certain zones, this lining naturally also being subject to the above-mentioned criteria/limitations, especially resistance and elasticity, whilst it is particularly important for it not to be secured to the outer fabric by stitching, yet exhibit a capacity for controlled extension as applicable, etc.

This is essentially the objective of the invention.

SUMMARY OF THE INVENTION

Generally speaking, it relates, as mentioned above, to an item of support lingerie incorporating at least one region moulded to create a three-dimensional retaining and support volume for at least one protuberant part of the human body, manufactured from a tubular knitted fabric made from a first extensible and heat-deformable material, provided with a ribbing constituting one of the edges of said article elastically enclosing the body, the final shape of the item of lingerie being made by cuts made in the knitted tube starting from the free edge opposite the ribbing, characterized in that each molded three-dimensional region is lined by at least one internally bonded lining made from a second extensible and heat-deformable material, one face of which is coated with a heat-activatable adhesive, the knitted fabric and lining materials on the one hand having a modulus of elongation, either by heat deformation or elastic, and the adhesive on the other hand having an activation temperature such that they enable deformation to be induced by hot-moulding the molded regions to impart a three-dimensional aspect to them without affecting the heat-bonded join, said first and second materials conserving their capacity to support and hold after molding.

Not only do the articles proposed by the invention afford maximum comfort due to the fact of using a knitted tube and bonded seams, they also exhibit bust supporting properties which enable brassieres to be made for every chest size, for example, including the largest requiring E or F size cups.

Whilst the support features are naturally linked to the double thickness of textile fabric, they are also due primarily to a judicious choice of materials for both the two layers of textile and for the adhesive, meeting the imperatives of mechanical strength over time and in space as well as the problems inherent in manufacture.

Accordingly, it is of vital importance during the heat-forming process that the two layers of textile react compatibly in terms of elongation whilst remaining bonded to one another. The same may be said with regard to the elastic and hence rebound elongation during day-to-day use of the product.

Tests have shown that the modulus of elongation of the materials used for the knitted fabric and the lining must exhibit a differential ranging between 0 and 140% and each fabric must be capable of undergoing an elongation greater than or equal to 40%. This is the requirement for good mechanical strength, particularly with regard to molding. In this respect, elongation is defined as being the percentage elongation and deformation of the material relative to its non-elongated state, caused by a linear force of 3N per centimeter.

If the above values are not complied with, there is a risk that one of the materials will slip relative to the other, thereby rupturing the adhesive/textile cohesion during molding, which will cause the two materials to come unstuck.

As regards the criteria for selecting appropriate materials, it should be pointed out that materials which permit too great an elongation must be ruled out because although they will permit perfect molding, they will not provide the subsequent mechanical strength needed to hold the breasts or buttocks.

In fact, the results of an experiment show that the first and the second materials should be made of a mixture of fibers containing at least 7% synthetic fibers. Polyester fibers, in particular, are suitable.

Synthetic fibers having a modulus of elongation can be perfectly mixed with natural fibers such as cotton which are not at all or not very extensible: it is the links created by the knitting stitches which permit elongation of the fabric if the extensible fibers are correctly disposed or aligned in said stitches.

By preference, said first and second materials are made of a mixture of polyamide and elastane.

This mixture permits suitable elastic elongation and heat-forming whilst affording a mechanical strength that will impart a proper stability to the product both over time and in space.

One of the key technical developments of the invention is in fact the adhesive, without which a lining could not be fixed. The cohesion of the two textile layers must be maintained under heat during the molding process, which in principle leads to a definitive stretching of certain fibers, and when cold when the product is not elastically stretched. Furthermore, this cohesion must not be altered by successive washes, even at high temperature.

A large amount of research and numerous tests have shown that the adhesive material may be selected from among the polyamides or from polyurethane adhesives. The criterion governing selection is the activation temperature of the adhesive, which must not in principle be detrimentally affected by the hot molding operation, conducted at a temperature of between 175° C. and 195° C.

More specifically, one possibility is to use an adhesive comprising a mixture of copolyamides whose activation temperature is between 165° C. and 195° C.

If using a polyurethane, the activation temperature will be between 185° C. and 195° C.

Tests on materials with a lower activation temperature, for example in the order of 140° C. to 150° C., even up to 165° C., have led to problems due to unsticking because the adhesive comes apart from the substrates during molding.

Apart from these problems of temperature, the choice of adhesive material will depend on the capacity of whatever materials are used to cohere with the textile layers. The chosen copolyamide mixture as well as polyurethane are effective in this respect.

It should also be pointed out that the adhesive with a copolyamide base is disposed on one face of the lining in the form of dots laid out in repetitive patterns. This mode of application has a double advantage in that it avoids making the lining thicker and it allows it to retain its breathability. If using a polyurethane adhesive, which is better suited to a more refined molding process, the adhesive is disposed on the face of the lining in the form of a continuous film.

In a preferred application, the invention relates to a brassiere and is thus made from a tubular knitted fabric provided with a ribbing forming the bottom skirt enclosing the bust of said brassiere, the region of the cups being lined with an internally bonded front piece and molded to the shape of the breasts.

Clearly, by the region of the cups is meant the interior thereof as well as their immediate periphery and preferably the region linking them.

The latter also has a center piece, i.e. a triangular piece of fabric made from a non-extensible material inserted between said front piece and the knitted fabric in the region between the cups. This center piece, which stiffens the part located between the breasts, contributes to the support function by specifically preventing any horizontal deformation between the breasts.

By preference, one face of said center piece is coated with an adhesive enabling it to be bonded onto the knitted fabric. Even more preferably, said adhesive is the same as that used to bond the front piece and the knitted fabric.

In assembling this stiffening piece, the same benefits apply as those obtained by lining with the front piece, i.e. no over-thick stitched seams which can cause irritation, adhesive applied so as to allow the material to breathe, etc.

In one possible embodiment, the brassiere proposed by the invention is also designed so that each cup incorporates a reinforcement inserted in a compartment disposed between the front piece and the knitted fabric, said compartment bounding the bottom contour of the cup.

More specifically, said compartment is made from a textile tube without stitched seams, of a shape matching that of the reinforcement, having a very high density of threads and sewn onto the front piece.

The fact that the support band made as above is sewn onto the bonded face of the front piece means that the stitching is not visible from the right side of the product. Consequently, there is less extra thickness on a level with the support band, due to the lining proposed by the invention, and the reinforcement is less noticeable to the user. This design is therefore extremely advantageous because it significantly increases comfort while providing optimised support due to the presence of the reinforcement.

In addition to the brassiere, the invention also relates to a method of manufacturing a brassiere from a tubular knitted fabric constituting a first extensible and heat-deformable material, provided with a ribbing forming the bottom skirt of the brassiere, characterized by the following steps:

tracing the upper contours of the brassiere as the tube is knitted using stitches of a different texture for said contours;

bonding an internal lining of a second extensible and heat-deformable material in the region of the cups by hot-pressing at a temperature between 165° C. and 195° C.;

hot-molding the cups at a temperature between 175° C. and 195° C.;

cutting out the brassiere along the outline contours on the knitted tube;

joining front and rear portions of straps as cut.

The brassiere model is therefore designed on the basis of the tube knitted during the knitting process, which considerably facilitates the subsequent cutting operations enabling the final shape to be imparted to the product.

In one possible option, the upper contours of the brassiere are hemmed and stitched in an elasticating operation. These are essentially the contours of the straps, the width of which is therefore limited, conferring a more discrete appearance on said straps.

For practical reasons and to facilitate the manufacturing process, enabling said steps to be operated flat (bonding, molding), the basic tube is cut on a level with the back join, back tabs being added and provided with a hooking system.

In the method proposed by the invention, in order to obtain a product as described above, the lining is a front piece, of which the face bonded to the knitted fabric is faced beforehand with a triangular center piece of a non-extensible material, placed in the region between the cups. This center piece is itself coated beforehand with a layer of adhesive on its face that is not bonded to the front piece. Finally, in the case of reinforced brassieres, an additional step is integrated in the method, which consists in stitching tubes of non-stitched tubular textile material against the face of the lining which is bonded to the knitted fabric, said tubes being provided in order to accommodate reinforcements delimiting the bottom contour of the cup.

The present invention does not only apply to brassieres; it additionally relates to briefs, which are therefore also made from a knitted tube provided with a ribbing enclosing the waist of the body and characterized in that the region of the buttocks is reinforced by at least one internally bonded lining and molded to the shape of the buttocks.

The problems inherent in making briefs are generally the same as those intrinsic to brassieres, although the mechanical constraints are a priori not as great.

This being the case, the degree of molding, which is often less than that required for brassieres with deep cups, requires a localized lining on a level with the buttocks, which may be selectively applied during molding, and their immediate periphery.

BRIEF DESCRIPTION OF THE DRAWINGS

The invention will now be described in more detail with specific reference to the appended drawings, of which:

Turning to FIG. 1, the knitted tube (1) has a ribbing (2) that will subsequently form the skirt of the brassiere (see FIG. 4), which is perfectly elastic since it is a knit with a reverse stitch (false ribbing) made directly by the knitting machine. This enables the "tension") of the ribbing to be controlled, in other words, the give of the elasticity.

A specific knit may be used to trace the upper contour of the brassiere with the cups (3, 4), the front parts of the straps (5, 6) and their rear parts (7, 8) which practically meet on a level with the ribbing (2).

Figure 1:
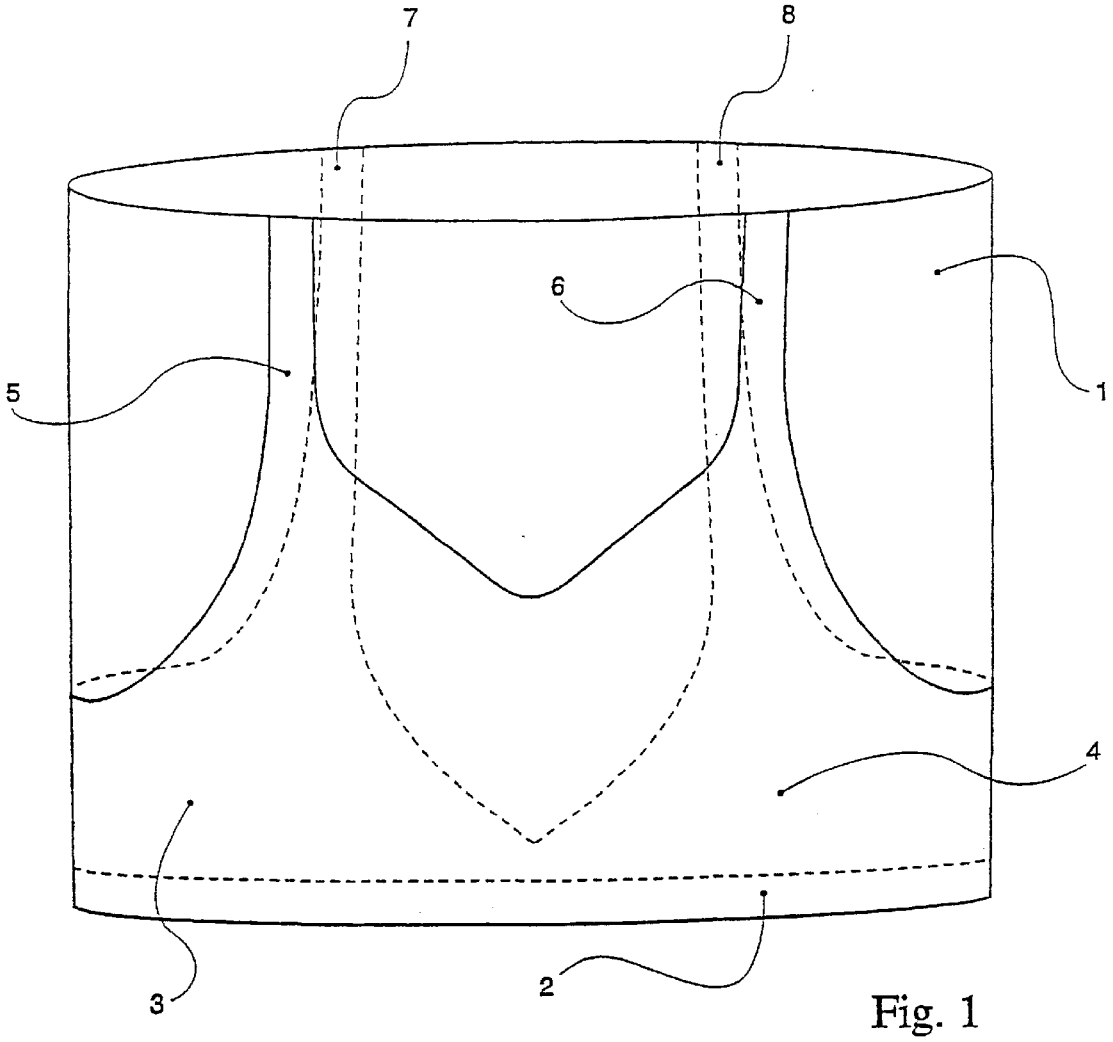
FIG. 1 depicts a perspective view of a knitted tube on which the outline of a brassiere has been traced.
Figure 2:
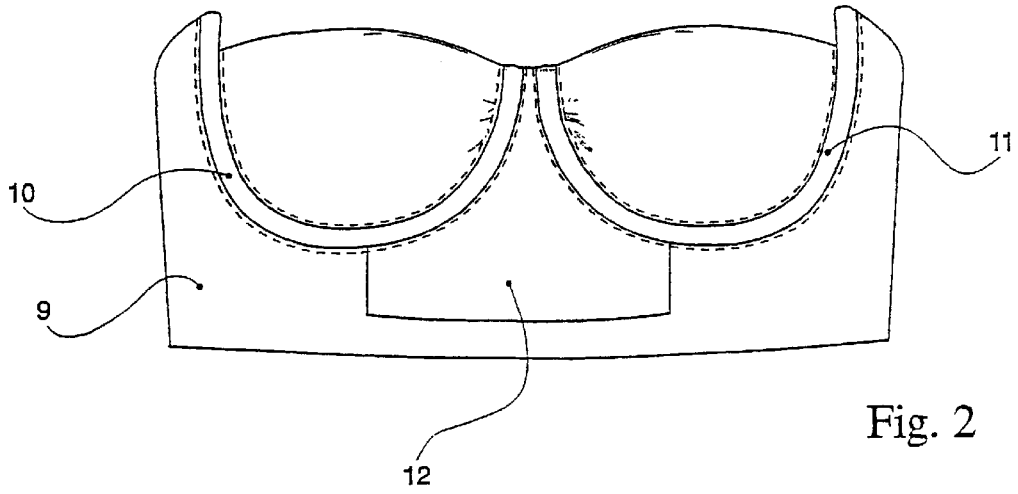
FIG. 2 shows a front piece to be bonded onto the knitted fabric illustrated in FIG. 1, on a level with the contour of the cups.

FIG. 2 illustrates the front piece (9) or lining onto which textile tubes (10, 11) of a low thickness have been stitched, said tubes (10, 11) themselves not being provided with stitching so as to avoid any additional thickness likely to irritate the skin of the breasts. These tubes are made from a fine yarn with a very dense mesh to prevent the reinforcement inserted therein (not illustrated) from working out through the stitches. A center piece (12), being a piece of non-extensible material of triangular shape, is bonded onto the face having the textile tubes (10, 11) accommodating the reinforcements, on a level with the mid-back.

Figure 3:
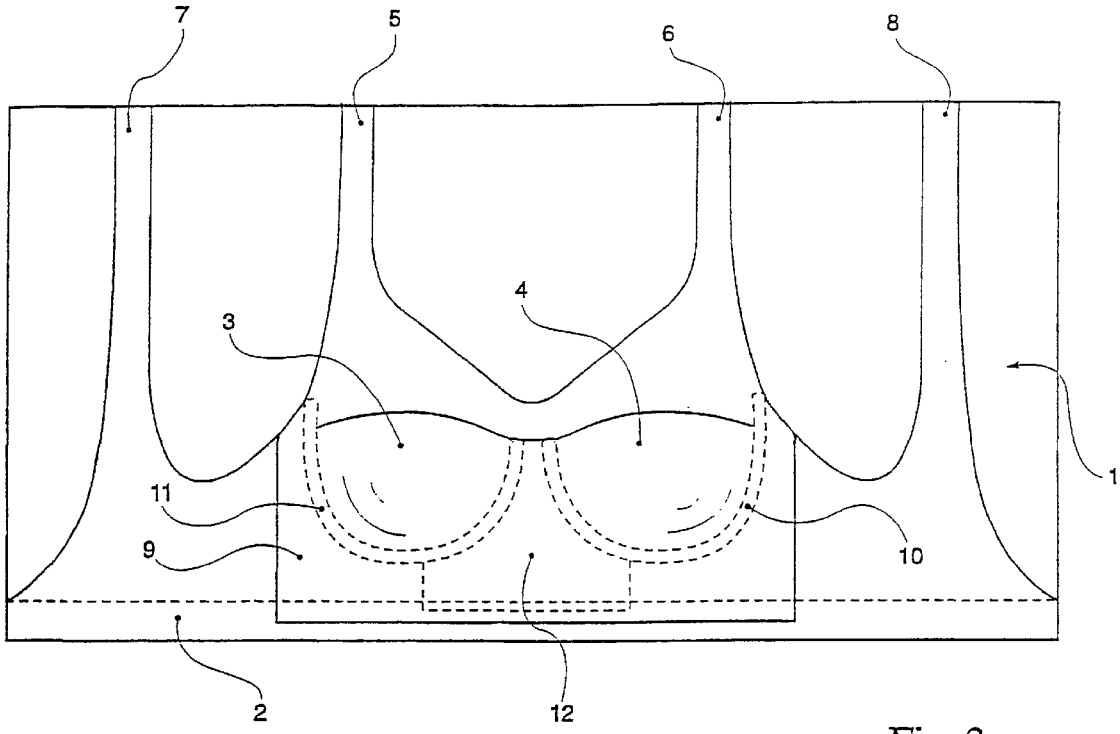
FIG. 3 illustrates the bonding of said front piece in the region of the cups, on a knitted fabric cut along a direction of the knitted tube and laid out flat.

In one option, the knitted fabric is cut at the point at which the rear straps (7, 8) meet and is laid out flat (FIG. 3) for the purpose of bonding the front piece (9). The latter is bonded so that the textile tubes (10, 11) accommodating the reinforcements on the one hand and the center piece (12) on the other are disposed between the front piece (9) and the knitted fabric (1).

Figure 4:
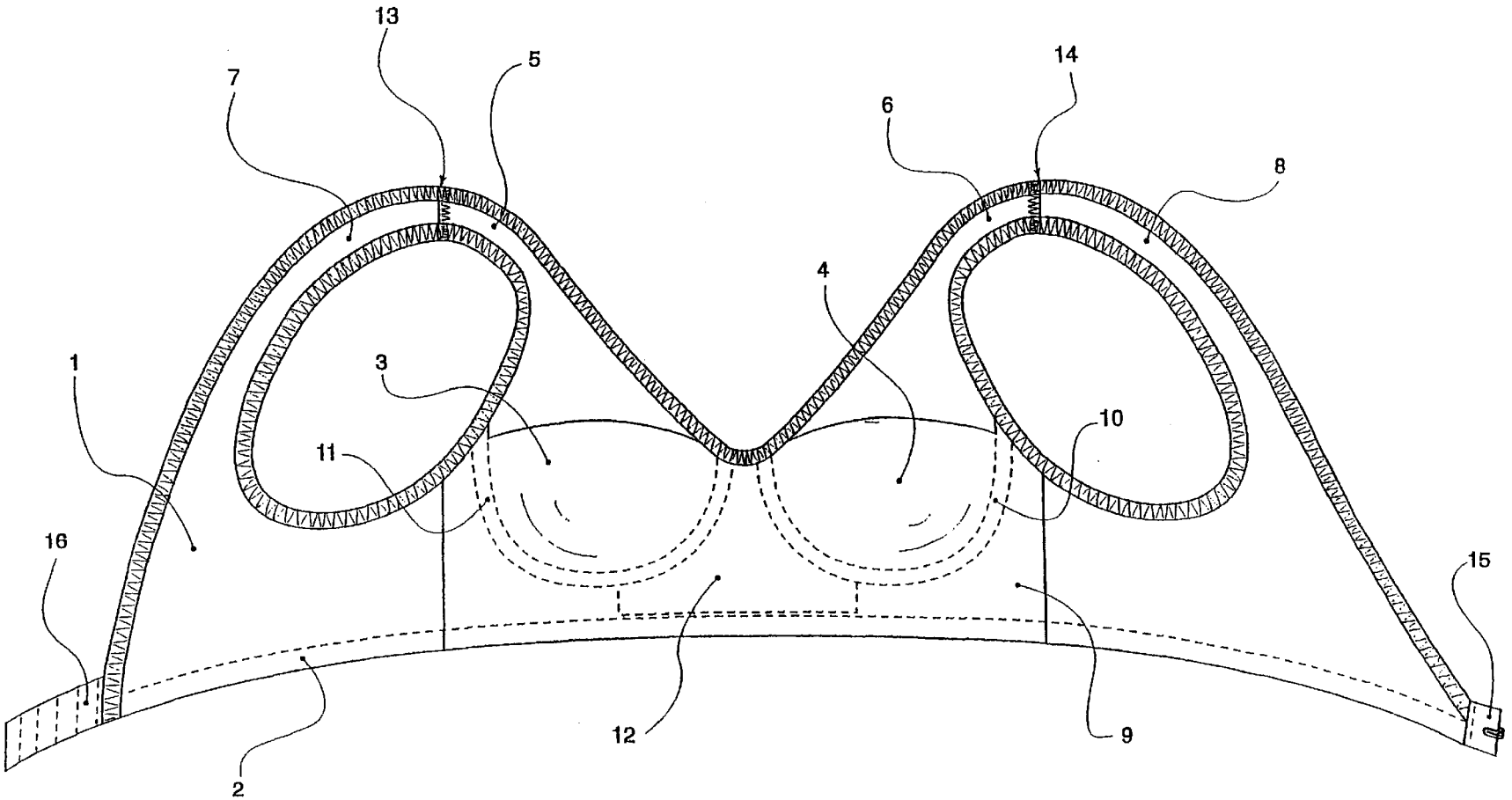
FIG. 4 shows a finished brassiere.

Turning to FIG. 4, the finished brassiere has had the edges of the straps (5, 7; 6, 8) elasticated, having been joined at (13, 14) by any known means. Also, the back tabs (15, 16) with means enabling them to be fixed to one another have been attached to the knitted fabric (1).

The fixing means may be bonding, welding, stitching, etc.

Figure 5:
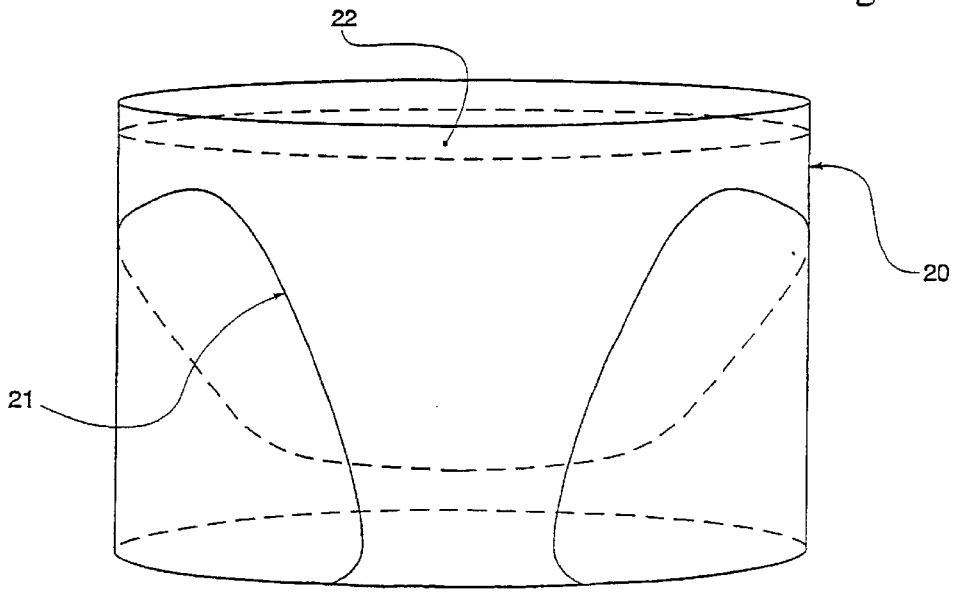
FIG. 5 illustrates a knitted tube on which the outline of a pair of briefs has been traced.

Finally, FIG. 5 shows a knitted tube (20) on which a knitting stitch different from the rest of the knitwork (20) outlines the contours (21) of a pair of briefs. In this case, the ribbing (22) is at the top and encloses the waist of the user. Depending on the circumstances, the part located between the legs may also be made from a different knitting stitch and/or from a different material for reasons pertaining to hygiene, comfort, etc.

The present invention having been thus described with particular reference to the preferred forms thereof, it will be obvious that various modifications may be made therein without departing from the spirit and scope of the present invention as defined in the appended claims.

What is claimed is:

1. A support garment comprising at least one region that is molded to create a three-dimensional retaining and support area for at least one protuberant part of a wearer's body, said support garment being manufactured from a tubular knitted fabric, said fabric being made from a first extensible and heat-deformable material, said first material being provided with a ribbing that constitutes a bottom edge of said support garment to elastically encircle the body of a wearer, said support garment being defined by a plurality of cuts made in said tubular knitted fabric, said three-dimensional area being lined by at least one lining made from a second material, said second extensible and heat-deformed material having a first face that is coated with a heat-activatable adhesive, said first and second materials having a modulus of elongation created by heat deformation or elastic, said adhesive having an activation temperature such that it enables deformation to be induced by hot-molding of said at least one region to impart a three-dimensional aspect to said at least one region without affecting adhesion between said first and second materials.

2. The support garment of claim 1, wherein said first and second materials hold together after molding.

3. The support garment of claim 1, wherein said modulus of elongation of said first and second materials exhibits a differential therebetween ranging between 0% and 140%, and wherein each of said first and second materials has an elongation greater than or equal to 40%.

4. The support garment of claim 1, wherein said first and second materials are made of a mixture of fibers containing at least 7% synthetic fibers.

5. The support garment of claim 4, wherein said synthetic fibers are polyester.

6. The support garment of claim 1, wherein said first and second materials are made of a combination of polyamide and elastane.

7. The support garment of claim 1, wherein said adhesive material is a polyamide.

8. The support garment of claim 1, wherein said adhesive material is a mixture of copolyamides, said copolyamides having an activation temperature ranging between 165° C. and 195° C.

9. The support garment of claim 1, wherein said adhesive material is disposed on a face of said second material in the form of dots laid out in repetitive patterns.

10. The support garment of claim 1, wherein said adhesive material is a polyurethane adhesive having an activation temperature ranging between 185½ and 195° C.

11. The support garment of claim 1, wherein said adhesive material is disposed on a face of said second material in the form of a continuous film.

12. The support garment of claim 1, wherein said support garment is a brassiere.

13. The support garment of claim 12, wherein said brassiere has a pair of breast cups with each breast cup being lined with a front piece, said front piece being molded to the shape of the breasts, said front piece being attached to said first material by an adhesive material.

14. The support garment of claim 13, wherein said brassiere has a center piece of non-extensible fabric inserted between said front piece and said first material in a region between said pair of breast cups.

15. The support garment of claim 14, wherein said center piece is coated on one side with said adhesive material for enabling said center piece to be attached to said first material.

16. The support garment of claim 13, wherein said adhesive material is the same as that used to attach said front piece and said first material.

17. The support garment of claim 12, wherein each of said pair of breast cups has an underwire inserted in a compartment disposed between said front piece and said first material, said compartment defining a bottom contour of each of said pair breast cups.

18. The support garment of claim 17, wherein said compartment is made from a textile tube without stitching, said compartment having a shape matching that of said underwire, said compartment having a very high density of threads and sewn to said first material.

19. The support garment of claim 1, wherein said support garment is a brief, said brief being made from a tubular knitted fabric, said brief having a ribbing encircling a waist of a body of a wearer, said brief being reinforced by at least one lining and molded to a shape of buttocks of the wearer.

20. A method of manufacturing a brassiere from a tubular knitted fabric having a first extensible and heat-deformable material, the method comprising:

outlining a contour of said brassiere during knitting of said fabric using a plurality of stitches having different textures for said contour;

bonding an internal lining of a second extensible and heat-deformable material to a pair of breast cups of said brassiere by hot-pressing at a temperature ranging between 165° C. and 195° C.;

hot-molding said pair of breast cups at a temperature ranging between 175° C. and 195° C.;

cutting out said brassiere along said contour on said knitted fabric forming a front portion and a rear portion; and joining said front and rear portions.

21. The method of manufacturing said brassiere from knitted fabric of claim 20, wherein said contour of said brassiere is hemmed and stitched in an elasticating operation.

22. The method of manufacturing said brassiere from said knitted fabric of claim 20, wherein said knitted fabric is cut on a level leaving a pair of back tabs, said back tabs being provided with a closure system.

23. The method of manufacturing said brassiere from said knitted fabric of claim 20, wherein said lining is a front piece having a first face attached to said knitted fabric, said first face being positioned directly opposite to a triangular center piece of a non-extensible material placed in a region between said pair of breast cups.

24. The method of manufacturing said brassiere from said knitted fabric of claim 23, wherein said center piece is coated with a layer of adhesive on a second face that is not attached to said front piece.

25. The method of manufacturing said brassiere from said knitted fabric of claim 20, wherein said first face of said front piece has one or more tubes of a non-stitched tubular textile are stitched thereto, said one or more tubes being provided to accommodate an underwire.

* * * * *